US010941025B2

(12) United States Patent
Van Der Schuit

(10) Patent No.: US 10,941,025 B2
(45) Date of Patent: Mar. 9, 2021

(54) EXPANDABLE HEAVY EQUIPMENT, AND ELONGATED PULL ELEMENT

(71) Applicant: Cabin Air Group B.V., Joure (NL)

(72) Inventor: Rinze Jan Van Der Schuit, Oranjewoud (NL)

(73) Assignee: Cabin Air Group B.V., Joure (NL)

( * ) Notice: Subject to any disclaimer, the term of this patent is extended or adjusted under 35 U.S.C. 154(b) by 0 days.

(21) Appl. No.: 16/979,563

(22) PCT Filed: Mar. 28, 2019

(86) PCT No.: PCT/NL2019/050194
§ 371 (c)(1),
(2) Date: Sep. 10, 2020

(87) PCT Pub. No.: WO2019/190322
PCT Pub. Date: Oct. 3, 2019

(65) Prior Publication Data

US 2021/0009387 A1 Jan. 14, 2021

(30) Foreign Application Priority Data

Mar. 29, 2018 (NL) ..... 2020693
May 18, 2018 (NL) ..... 2020962

(51) Int. Cl.
*B66C 23/00* (2006.01)
*B66C 23/82* (2006.01)
*B66C 23/68* (2006.01)

(52) U.S. Cl.
CPC ..... *B66C 23/821* (2013.01); *B66C 23/68* (2013.01); *B66C 2700/0371* (2013.01)

(58) Field of Classification Search
CPC ..... B66C 23/26; B66C 23/365; B66C 23/50; B66C 23/70; B66C 23/821
See application file for complete search history.

(56) References Cited

U.S. PATENT DOCUMENTS 5,016,973 A * 5/1991 Hager ..... G02B 6/4432 385/102
6,672,046 B1 * 1/2004 Prewo ..... D07B 1/005 57/232
6,886,484 B2 * 5/2005 Thomas ..... B63H 9/08 114/108
7,882,629 B2 * 2/2011 Chadbourne ..... H02G 7/056 29/862
8,252,411 B2 * 8/2012 Veronesi ..... B66B 7/062 428/292.1
10,520,406 B2 * 12/2019 Starke ..... G01N 3/02
(Continued)

FOREIGN PATENT DOCUMENTS

DE 20219281 U1 4/2004
DE 202009014031 U1 1/2010
WO 2015103223 A1 7/2015

*Primary Examiner* — Emmanuel M Marcelo
(74) *Attorney, Agent, or Firm* — Rogowski Law LLC

(57) ABSTRACT

An elongated pull element (14), in particular for an element of an expandable heavy equipment (1) comprises a bundle of load bearing fibers/fibres (41) extending along the length of the elongated pull element (14), and stiffening means (54) comprising an exoskeleton for increasing the bending stiffness of the elongated pull element (14), compared to the bending stiffness of the load bearing fibers/fibres (41).

15 Claims, 4 Drawing Sheets

Fig. 3

(56) References Cited

U.S. PATENT DOCUMENTS

| | | | | |
|---|---|---|---|---|
| 2003/0010966 | A1* | 1/2003 | Sjostedt | B66C 1/12 254/231 |
| 2004/0050580 | A1 | 3/2004 | Hager et al. | |
| 2011/0089130 | A1 | 4/2011 | Stephan | |
| 2015/0110451 | A1* | 4/2015 | Blazer | G02B 6/4432 385/103 |
| 2016/0221805 | A1* | 8/2016 | Munuswamy | B66C 23/821 |
| 2017/0073201 | A1* | 3/2017 | Moore | F16G 11/12 |
| 2018/0320756 | A1* | 11/2018 | Campbell | B29C 70/443 |
| 2019/0084803 | A1* | 3/2019 | Eastman | B66B 7/062 |
| 2020/0378065 | A1* | 12/2020 | Campbell | D07B 9/00 |

* cited by examiner

EXPANDABLE HEAVY EQUIPMENT, AND ELONGATED PULL ELEMENT

CROSS-REFERENCE TO RELATED APPLICATIONS

This application is a national stage application (under 35 USC § 371) of PCT/NL2019/050194, filed Mar. 28, 2019, which claims benefit of Netherlands application No. 2020693, Mar. 29, 2018, and Netherlands application No. 2020962, filed May 18, 2018, the contents of each of which are incorporated by reference herein.

BACKGROUND OF THE INVENTION

A heavy equipment of this type is used for industrial activities, such as construction work, lifting heavy loads, drilling for natural resources, mining, and excavating, including activities in outer space. The word "heavy" in the phrase "heavy equipment" relates to the load being displaced or force being exerted by the equipment, as the equipment itself may be of heavy weight, but is not necessarily so. Expandable heavy equipment is usually employed on a temporary basis at a certain worksite. For the sake of its transport, the heavy equipment can be compacted. On or near the worksite, the heavy equipment is expanded to its working condition. A typical example of an expandable heavy equipment is a crane, such as a crawler crane. Other examples are oil derricks, offshore platforms, mining equipment, space stations, and scaffolding.

DE-202.19.281 discloses a crawler crane with a crane jib brace. The brace comprises a tensile part in the form of a multi-layer tensile loop made of a carbon fiber/fibre band. An aluminum cover is provided to protect the carbon fiber/fibre band.

A known expandable heavy equipment of this type is a crawler crane. The known crane has a frame comprising a boom, and may comprise a jib. The boom and jib each comprise multiple elements which are connected by means of pin-hole connections. In a transport condition, the elements of the boom and jib are put together in a compact arrangement. In a working condition, the elements of the boom and jib are connected to each other in a length direction. The elements of the boom and/or jib are provided with a steel rod or steel plate at the outside of the frame element. "Outside of the frame element" is understood within the context of this specification as that in a side view the steel rod is at a side of the boom, if the boom is in a substantial vertical position, and on top of the boom or jib, if the boom or jib is in a substantial horizontal position. When assembling the crane, the steel rods or plates are connected to each other using pin-hole connections.

A disadvantage of the known expandable heavy equipment is that the equipment itself has a relatively large weight which reduces the payload of the expandable heavy equipment of a given size.

The invention aims to solve at least one of these problems, or at least to provide an alternative. In particular, the invention aims to provide an expandable heavy equipment with a reduced own weight.

SUMMARY OF THE INVENTION

An expandable heavy equipment comprises a frame with a first frame element, a connector, at least one elongated pull element, and further frame elements, the further frame elements comprising at least a second frame element. The elongated pull element comprises a first coupler at a first end and a second coupler at a second end opposite of the first end, and is connected at the first end to the second frame element or to a further elongated pull element with the first coupler and at the second end to one of the further frame elements or to a further elongated pull element with the second coupler. A transport condition is defined wherein the first frame element and the second frame element are arrangeable compact together and a working condition is defined wherein the first frame element and the second frame element occupy more space in at least one direction than in the transport condition. The connector allows a movement of the first frame element and the second frame element with respect to each other from the transport condition to the working condition, and the connector is arranged for connecting the first frame element and the second frame element in the working condition. The elongated pull element is designed to transfer a pull force in the working condition. The elongated pull element comprises a bundle of load bearing fibers/fibres extending from the first coupler to the second coupler, and stiffening means for increasing the bending stiffness of the elongated pull element compared to the bending stiffness of the bundle of load bearing fibers/fibres. The stiffening means comprises an exoskeleton, which comprises one or more rods, provided outside of the bundle of load bearing fibers/fibres, and extending in a length direction of the elongated pull element.

Load bearing fibers/fibres have a better weight-to-load ratio than steel pull rods. However, they are commonly considered to be unsuitable for elongated pull elements in several applications, as their length cannot be guaranteed, in particular not after handling the elongated pull element. The stiffening means ensure that the elongated pull element does not bend excessively when being handled and/or that the elongated pull element returns to its original shape after being handled. This results in the length of the elongated pull element not changing. As the elongated pull element needs to be connected to another element, and the frame elements determine the position of the first and second coupler, a fixed and guaranteed length of the elongated pull element is important in order to enable connecting the elongated pull element to another element. The exoskeleton formed by one or more rods, provided outside of the bundle of load bearing fibers/fibres, increases the bending stiffness of the elongated pull element in an effective way.

The stiffening means increase the bending stiffness of the elongated pull element compared to the bending stiffness of the bundle of load bearing fibers/fibres substantially, i.e. at least 20 times, preferably at least 40 times, more preferably at least 60 times.

The invention is in particular advantageous with an elongated pull element having load bearing fibers/fibres with a relatively high elastic modulus. "Relatively high elastic modulus" is to be understood as a Young modulus of at least 90 GPa, preferably at least 110 GPa.

Preferably, the load bearing fibers/fibres extend parallel to each other in the length direction of the elongated pull element. This orientation reduces unwanted stretch, such as occurs with twisted yarns.

In an embodiment, the elongated pull element comprises compression means. By applying compression means in a tight manner around a section of the load bearing fibers/fibres, the load bearing fibers/fibres are compressed together, resulting in an increase of the stiffness of the elongated pull element.

In an embodiment, the elongated pull element comprises tape, provided helically around the load bearing fibers/fibres.

Applying tape is in itself preferred, as it bundles the load bearing fibers/fibres in a compact manner. By applying the tape in a relative loose manner, the load bearing fibers/fibres are not substantially compressed and the elongated pull elements would still be relatively flexible, i.e. as flexible as the specific load bearing fibers/fibres allow. By applying the tape under tension, the tape functions as compression means, and the load bearing fibers/fibres are compressed together, resulting in a more stiff pull element.

In an embodiment, the elongated pull element comprises a sleeve, arranged circumferentially around the elongated pull element. In particular, the sleeve comprises a fiber-reinforced plastic, more in particular a fiber-reinforced epoxy. A sleeve in itself protects the load bearing fibers/fibres of the elongated pull element against an environment influence, such as exposure of sunlight, water or dirt on the load bearing fibers/fibres and/or the impact of an object against the elongated pull element. A reinforced sleeve acts as exoskeleton.

In an embodiment, the load bearing fibers/fibres of the elongated pull element extend from the first coupler to the second coupler, turn around the second coupler, extend from the second coupler to the first coupler, and turn around the first coupler, such as to form a semi-continuous loop. Such a semi-continuous loop results in an effective use of the load bearing fibers/fibres, as the first and second couplers are embedded within the loop and thus little or few auxiliary tools are required to connect the couplers to the load bearing fibers/fibres. Moreover, the formation of a semi-continuous loop enables the use of specific types of synthetic fibers/fibres, in particular synthetic fibers/fibres which are sensitive for compression and/or have a low mutual friction.

The term "semi-continuous loop" refers to the fact that the fibers/fibres have a finite length with distinct ends, while in a "continuous loop" a fiber/fibre would have no ends. So in a semi-continuous loop, the fibers/fibres are wound around the first and second coupler a plurality of times, forming a plurality of loops around these couplers, which is not completely continuous as the ends of the yarn are not connected to each other. It is noted that in practice fibers/fibres are most often provided as a yarn comprising a plurality of individual fibers/fibres, and an individual yarn, or a plurality of yarns, is/are wound around the first and second couplers in order to form the elongated pull element.

In an embodiment, at least one of the first and second couplers comprises a thimble, and in particular further comprises a matching pin. The relevant pin may have any shape, such as a straight pin, or a U-shaped pin as in a shackle. A thimble, in particular in combination with a pin, provides for a simple and effective connection to a frame element or to another elongated pull element.

In an embodiment, the first coupler of the elongated pull element matches a coupler of an adjacent further elongated pull element or frame element. In particular the first coupler and the coupler of the adjacent element are connectable in a male-female manner, i.e. one coupler fitting in the other.

In an embodiment, the load bearing fibers/fibres comprise synthetic fibers/fibres, in particular the synthetic fibers/fibres are Ultra High Molecular Weight Polyethylene fibers/fibres (UHMWPE fibers/fibres). A yarn with such fibers/fibres is sold under the registered trademark Dyneema™. Such fibers/fibres provide a high load to weight ratio.

In another embodiment, the synthetic fibers/fibres are aramid fibers/fibres, more in particular aramid fibers/fibres coated with a wax. Aramid fibers/fibres provide a high load to weight ratio too. The wax reduces the wear of the aramid fibers/fibres, as it reduces the mutual friction of the fibers/fibres in the elongated pull element.

In an embodiment, the expandable heavy equipment further comprises a drive for moving the expandable heavy equipment and/or for lifting a load.

The elongated pull element for an expandable heavy equipment according to another aspect of the invention achieves the same or similar effects as described above in relation to the expandable heavy equipment, resulting in a lighter pull element for an expandable heavy equipment than the known pull elements.

An elongated pull element according to the invention, either per se or as part of an expandable heavy equipment, is designed to bear a pull force and substantially no push force. In particular, the maximum push load is less than 25%, more in particular less than 10%, more in particular less than 5% of the maximum pull load on the elongated pull element.

The invention further relates to the use of an expandable heavy equipment, the elongated pull element, and/or of a frame element provided with an elongated pull element.

DESCRIPTION OF THE DRAWINGS

The invention, its effects, and advantages will be explained in more detail on the basis of the schematic drawing, in which.

DETAILED DESCRIPTION

Figure 1:
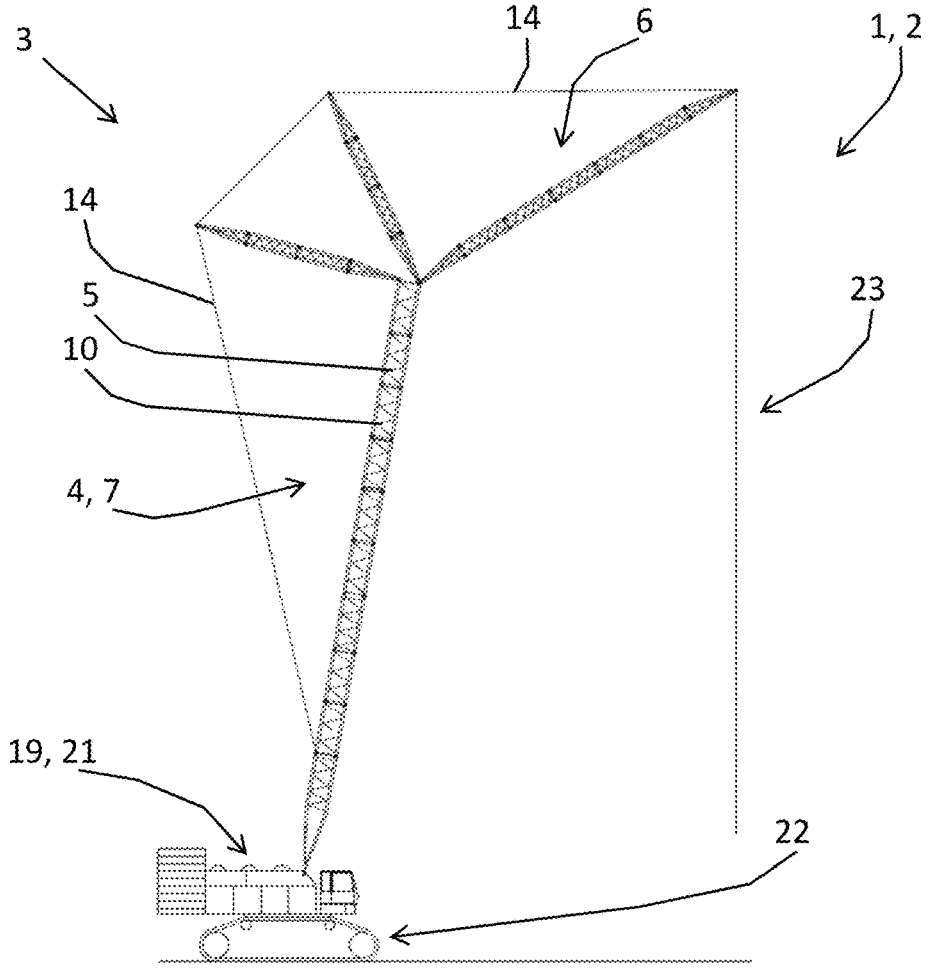
FIG. 1 shows a crawler crane according to the invention in a working condition.
Figure 2:
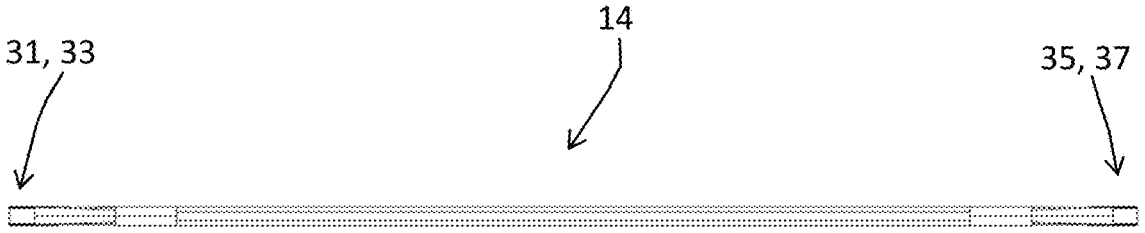
FIG. 2 shows an elongated pull element according to the invention in a top view.
Figure 7:
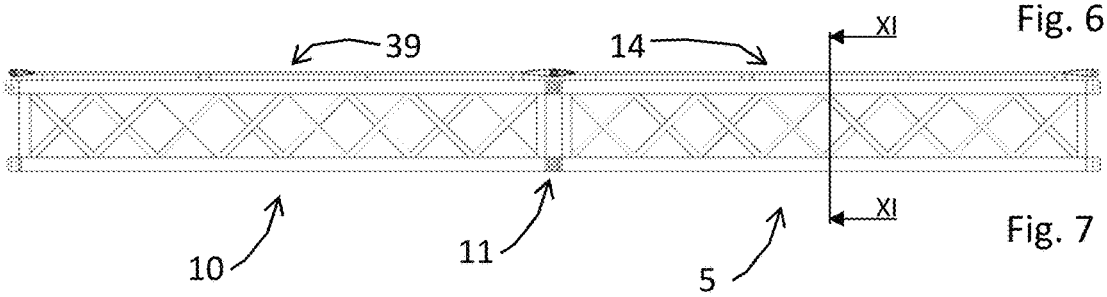
FIG. 7 shows the two frame elements of FIG. 6 in a coupled state.

The FIGS. 1 and 2 show an expandable heavy equipment, according to the invention, which is denoted in its entirety by reference number 1. The expandable heavy equipment 1 is in this embodiment a crane, in particular a crawler crane 2. The crawler crane 2 comprises a frame 3 with a boom 4, having a first frame element 5, and a jib 6. The frame 3 comprises further frame elements 7, including second frame element 10. The frame 3 further comprises a plurality of connectors 11, which in this embodiment are pin-hole connectors (see FIGS. 7 and 9; not shown in detail), and multiple elongated pull elements 14 (see FIGS. 2-13). The pin-hole connectors, and/or bolts and nuts are arranged for connecting the first frame element 5 with the second frame element 10, as well as the further frame elements 7 of the boom 4 and the jib 6 to each other.

The crawler crane 2 of this embodiment further comprises a drive 19 for erecting the boom 4 and jib 6 of the crawler crane 2. In this embodiment, the same drive 21 is designed for moving crawler tracks 22 of the crawler crane 2 and for lifting a load via a lifting cable 23 and hook (not shown).

Figure 3:
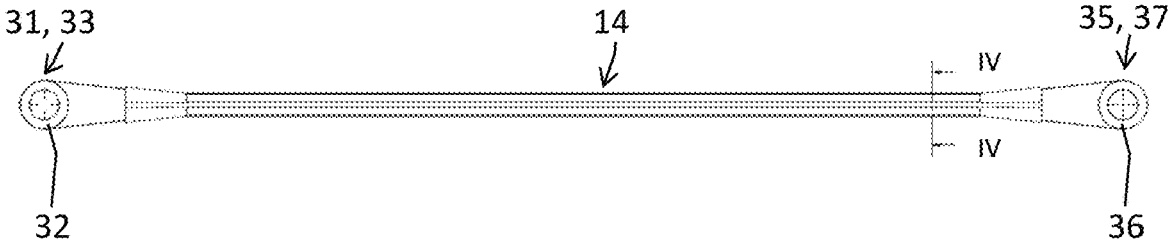
FIG. 3 shows the elongated pull element of FIG. 2 in a side view.
Figure 4:
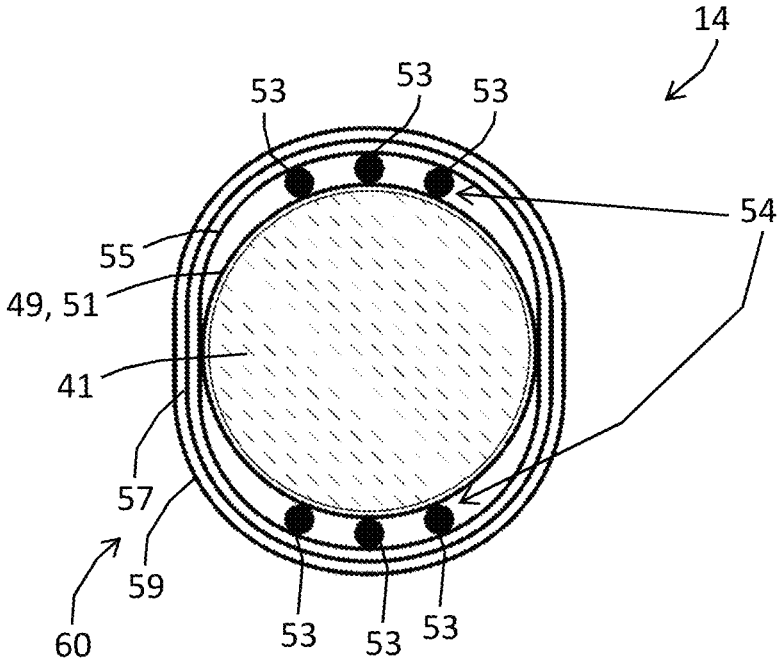
FIG. 4 shows a cross section, taken along line IV-IV in FIG. 3, of the elongated pull element.
Figure 12:
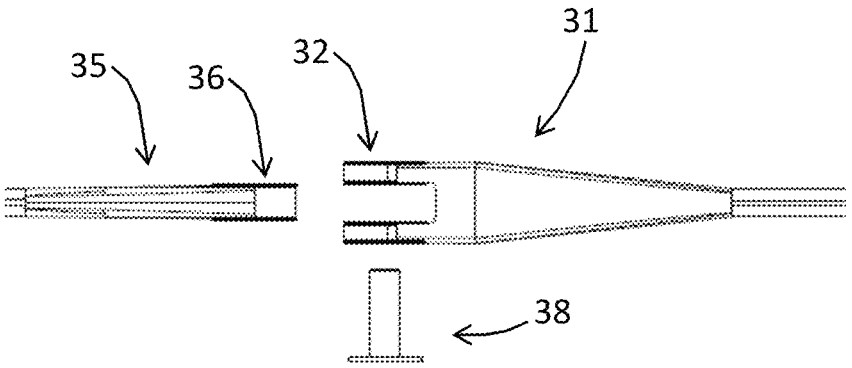
FIG. 12 shows two couplers in an uncoupled state.
Figure 13:
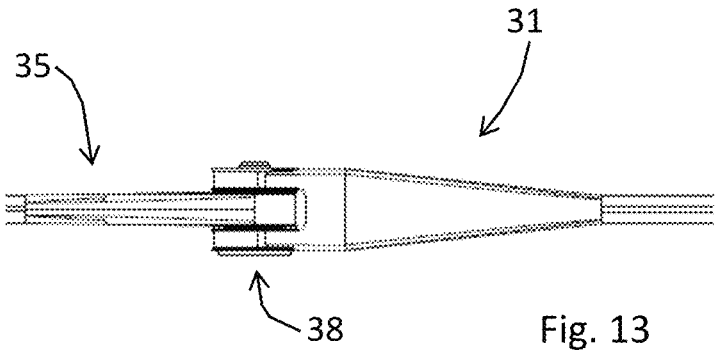
FIG. 13 shows the two couplers of FIG. 12 in a coupled state.

Referring to FIGS. 2 and 3, the elongated pull element 14 comprises a first coupler 31, in this embodiment with thimble 32, at a first end 33, as well as a second coupler 35, in this embodiment with thimble 36, at a second end 37 opposite of the first end 33 (shown in more detail in FIGS. 12 and 13).

Referring to FIGS. 6-9, the elongated pull element 14 is provided on top of first frame element 5 and connected at the first end 33 to a second pull element 39 with the first coupler 31 and at the second end 37 to a further pull element (not shown) with the second coupler 35. The elongated pull element 14 is designed to transfer a pull force from, in this case, the second pull element 39 to the further pull element. It is noted that in a working condition, the elongated pull elements form a chain of for instance ten elements, associated with as many frame elements, of which only two are shown in the FIGS. 6-9. It is to be understood that an elongated pull element at an end of this chain may be connected to a frame element instead of to another pull element.

Figure 8:
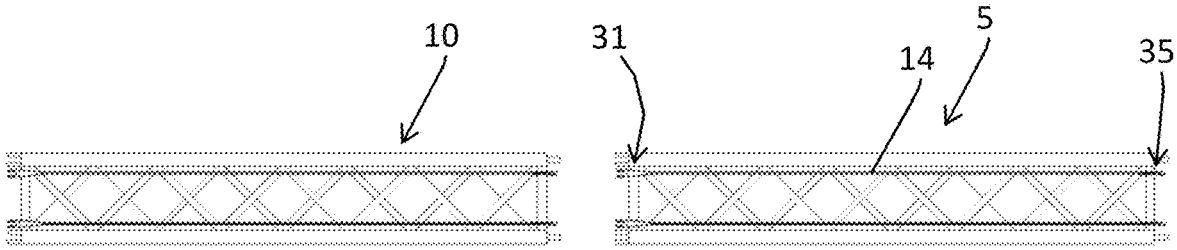
FIG. 8 shows the two elements of FIG. 6 in a top view.
Figure 9:
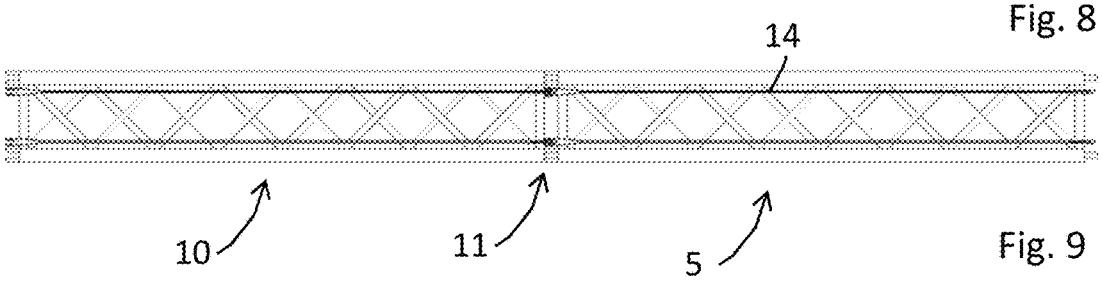
FIG. 9 shows the two elements of FIG. 7 in a top view.
Figure 10:
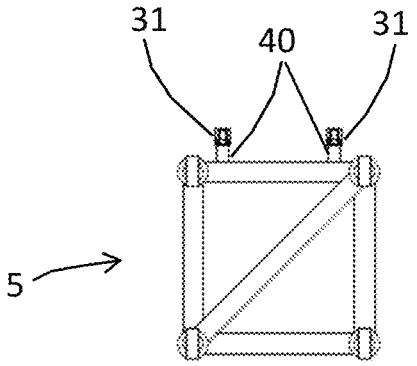
FIG. 10 shows a side view of one of the frame elements of FIG. 6.
Figure 11:
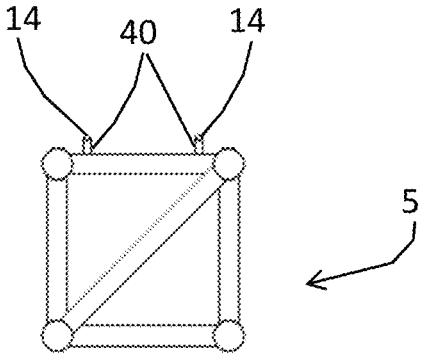
FIG. 11 shows a cross section, taken along line XI-XI in FIG. 7.

FIGS. 8 and 9 show that the first frame element 5 has two pull elements 14, which are identical in this embodiment and are provided parallel next to each other on the first frame element 5. Likewise, the second frame element 10 has two pull elements 39, provided parallel next to each other on the second frame element 10. The elongated pull elements 14, 39 are support on the respective frame element 5, 10 by mean of supports 40 (see also FIGS. 10 and 11). These supports 40 contribute to a reduced risk of bending or breaking of the elongated pull elements 14, and position the elongated pull elements at a distance from the frame elements 5, 10.

The elongated pull element 14 comprises load bearing fibers/fibres 41 (see FIG. 4) extending from the first coupler 31 to the second coupler 35. The load bearing fibers/fibres 41 comprise synthetic fibers/fibres, in this embodiment Ultra High Molecular Weight Polyethylene fibers/fibres (UHMWPE), sold under the trademark Dyneema™. Such load bearing fibers/fibres have a Young modulus of approximately 150 GPa. The load bearing fibers/fibres 41 extend from the first thimble 32 to the second thimble 36, turn around the second thimble 36, extend from the second thimble 36 to the first thimble 32, and turn around the first thimble 32. The individual fibers/fibres 41 have such a small cross section that they cannot be shown on this scale, and are shown schematically only.

The elongated pull element 14 of this embodiment comprises a first compression layer, or compression means 51, comprising compression tape 49, provided helical around the load bearing fibers/fibres 41 in order to bundle the load bearing fibers/fibres. The compression tape 49 increases the bending stiffness of the bundle of load bearing fibers/fibres 41 compared to a loose arrangement of the same load bearing fibers/fibres 41. The elongated pull element 14 further comprises an exoskeleton 54, comprising in this embodiment six rods 53 and a second compression layer comprising compression tape 55. The compression tape 55 fixates the rods 53 in their predetermined position, each opposite another rod 53. The elongated pull element further comprises a first braided cover 57 and a second braided cover 59. In this embodiment, the first braided cover 57 and the second braided cover 59 form a sleeve 60 with as main function to protect the exoskeleton 54 and underlying fibers/fibres 41.

The bending stiffness of this embodiment is order of magnitude hundred times that of a loose bundle of the same fibers/fibres 41. An elongated pull element 14 with a length of 6 meter has been tested by putting a weight of 70 kg in the middle of the elongated pull element 14, exerting a force transverse to its longitudinal direction. After removing the weight, the elongated pull element 14 showed the same length and shape as before applying the weight, i.e. the difference in length was less than 1 mm.

Figure 5:
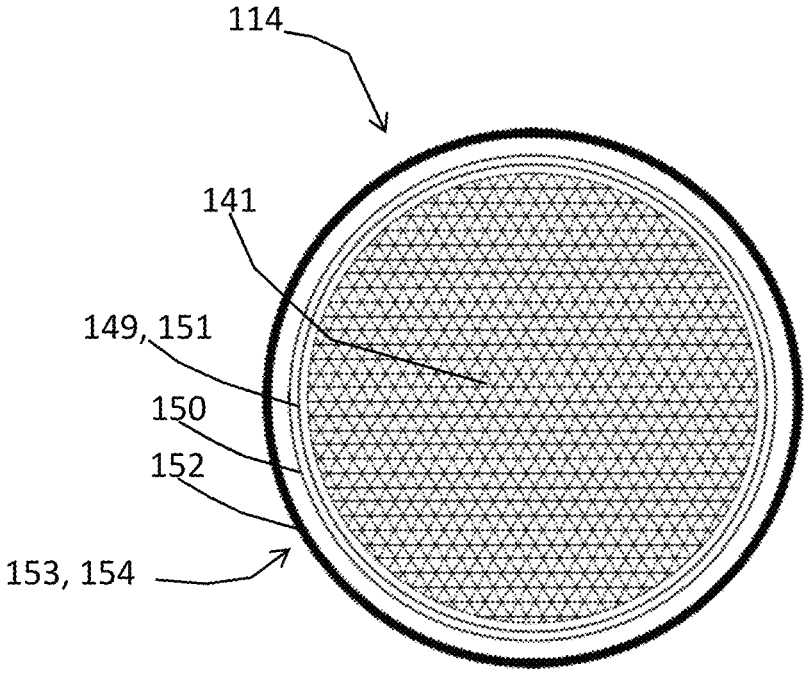
FIG. 5 shows a cross section of an alternative elongated pull element.
Figure 6:
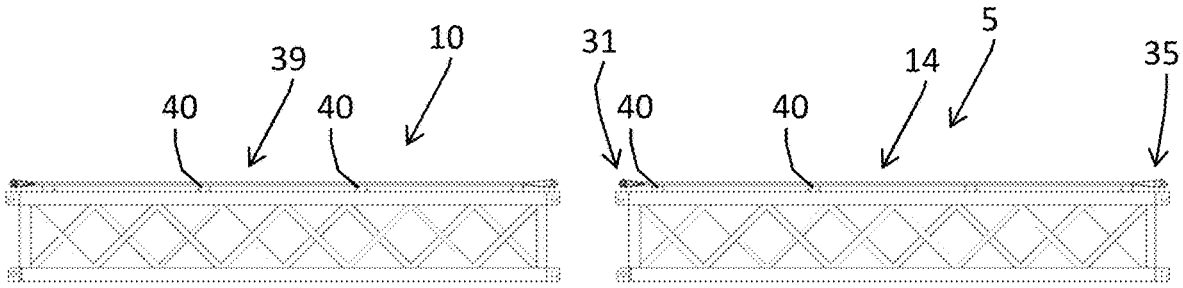
FIG. 6 shows two frame elements in an uncoupled state in a side view.

FIG. 5 shows an enlarged and schematic cross section of an alternative elongated pull element 114. It is to be noted that the elongated pull element 114 may look the same, or similar, in side view and top view as the elongated pull element 14, and therefore no extra figures comparable to FIGS. 2 and 3 are given. It is further noted that the different layers are shown in FIG. 5 apart for the sake of clarity of this drawing, but that the layers of the actual product abut. The individual fibers/fibres 141 have such a small cross section that they cannot be shown on this scale, and are shown schematically only.

The elongated pull element 114 of this embodiment comprises a first compression layer 149, comprising compression tape, and seal tape 150, provided helical around the load bearing fibers/fibres 141 in order to bundle the load bearing fibers/fibres. In this embodiment the compression tape 149 functions as compression means 151. The compression tape 149 is arranged to compress the load bearing fibers/fibres 141 into such a compact arrangement that the bending stiffness of the elongated pull element 114 is at least 20 times that of an elongated pull element with the same load bearing fibers/fibres 141, but without a compression layer.

The elongated pull element 114 of this embodiment further comprises a braided cover 152. The braided cover and the seal tape 150 form together a sleeve 153, arranged circumferential around the elongated pull element 114. The sleeve 153 protects the load bearing fibers/fibres 141 against environmental influences. In this embodiment, the braided cover 152 protects the load bearing fibers/fibres 141 against sun light and impact by objects. The seal tape 150 protects the load bearing fibres 141 against dirt, and water. The braided cover 152 comprises fiber/fibre reinforced plastic, in particular epoxy. In this way, the sleeve 153 forms an exoskeleton 154, further increasing the stiffness of the elongated pull element 114, up to at least 50 times the bending stiffness of a loose bundle of the same load bearing fibers/fibres 141.

A preferred arrangement for coupling two elongated pull elements 14, 114 is shown in FIGS. 12 and 13. The thimble 32 of coupler 31 is split in two, and the two halves are separated from each other in their axial direction. This distance between the two halves corresponds to the width of thimble 36 of coupler 35. Accordingly, the thimble 32 forms a female coupler 31 designed to receive a male coupler 35. The male 35 and female 31 couplers are interconnected with a pin 38. It is noted that alternative arrangements of the couplers are possible, and that the elongated pull element 14 of FIG. 2 shows a male thimble 32, 26 at each end, which each may be connected to a female thimble of another elongated pull element. Coupling to male thimbles is possible as well. Coupling a male thimble to a female thimble has the advantage that the loads are transferred in a straight line parallel to the longitudinal axis of the elongated pull elements.

An expandable heavy equipment, such as the crawler crane 2 which has been described above, is used as follows. The crawler crane in the transport condition is transported to the site where installation or construction work is required. In this condition, the frame elements are stowed together in a compact way, and both the frame elements and the elongated pull elements are detached from each other. The different frame elements are moved with respect to each other from the transport condition to the working condition, e.g. by moving them separate from each other until they abut in their working condition so that they can be connected, for instance via pin-hole connections. By connecting the frame elements, a boom or jib is formed. After the frame elements are connected, the associated pull elements are connected to each other using the pins 38. Subsequently, the boom and/or jib are erected. During this progress, the elongated pull elements separate from the frame elements they were supported on, and extend at a distance from the relative boom or jib, as shown in FIG. 1.

After completion of the installation or construction work, the expandable heavy equipment, such as the crawler crane 2, is returned from the working condition to the transport condition. The connectors between the different frame elements are detached such that the frame elements can move freely with respect to each other to the transport condition. Either shortly before or after that, the elongated pull elements are detached from each other too.

Several variants are possible within the scope of the attached claims. The features of the above described preferred embodiments) may be replaced by any other feature within the scope of the attached claims, such as the features described in other embodiments, and in the following paragraphs.

In an embodiment, a (self-erecting) oil derrick, offshore platform, scaffolding, or other expandable heavy equipment comprises an elongated pull element according to the invention. The type of frame element supported by the elongated pull element depends on the type of equipment. Such types include, but are not limited to uprights, masts, platforms, and beams. In general, the elongated pull element according to the invention is suitable for replacing the pull rods or plates of existing types of equipment.

In an embodiment, an expandable heavy equipment requires auxiliary equipment, such as a separate crane, to install or demobilize the expandable heavy equipment. In an embodiment, the expandable heavy equipment requires separate transport means, such as a deep loader or a barge, to be transported.

Although cured carbon fibers/fibres provide good strength properties in the length direction of an elongated pull element, it has proven that such cured fibers/fibres are too brittle. A side load may lead to permanent deformation of the elongated pull element. Accordingly, the load bearing fibers/fibres are preferably not cured carbon fibers/fibres.

While the above described examples of expandable heavy equipment are provided with an elongated pull element as described above, the described and other expandable heavy equipment are provided in alternative embodiments with other embodiments of the inventive elongated pull element, within the scope of the attached claims, examples of which are given below.

In an embodiment, the load bearing fibers/fibres comprise aramid fibers/fibres, in particular aramid fibers/fibres coated with a wax. In an embodiment, the load bearing fibers/fibres comprise basalt fibers/fibres.

In an embodiment the load bearing fibers/fibres or yarns with load bearing fibers/fibres have a length which corresponds to the length of the elongated pull element. In this embodiment, the load bearing fibers/fibres do not form a loop around the connectors as described in the detailed description, but just extend from one connector to the other.

In an embodiment, the compression means are a plastic or metal foil, or a rope or yarn helically wrapped around the load bearing fibers/fibres. In an embodiment, two or more layers of compression tape are provided.

In an embodiment only compression means are provided as stiffening means. In an alternative embodiment, a fiber/fibre reinforced sleeve is used as exoskeleton, and no compression means are used, or the compression means contribute unsubstantially to the bending stiffness of the elongated pull element. A contribution of less than 20%, in particular less than 10%, to the bending stiffness is considered to be "unsubstantial" in the context of this description. Preferably, the sleeve is not made of metal, as this results in a relative large increase of weight and/or cost.

Embodiments with a type of exoskeleton are more robust and have a lower risk of length change due to bending during handling than an embodiment with only compression means and no exoskeleton.

In an embodiment, a clamp around each end of the elongated pull element, or a rod extending transverse from each end of the elongated pull element, is used as a coupler. In an embodiment, different types of couplers are used at the different ends of one elongated pull element.

The invention is further defined by the following numbered clauses:

1. Expandable heavy equipment (1), comprising a frame (3) with a first frame element (5), a connector (11), at least one elongated pull element (14), and further frame elements (7), the further frame elements (7) comprising at least a second frame element (10), wherein the elongated pull element (14) comprises a first coupler (31) at a first end (33) and a second coupler (35) at a second end (37) opposite of the first end (33), and is connected at the first end (33) to the second frame element (10) or to a further elongated pull element with the first coupler (31) and at the second end (37) to one of the further frame elements (7) or to a further elongated pull element with the second coupler (35), a transport condition is defined wherein the first frame element (5) and the second frame element (10) are arrangeable compact together and a working condition is defined wherein the first frame element (5) and the second frame element (10) occupy more space in at least one direction than in the transport condition, the connector (11) allows a movement of the first frame element (5) and the second frame element (10) with respect to each other from the transport condition to the working condition, and the connector (11) is arranged for connecting the first frame element (5) and the second frame element (10) in the working condition, the elongated pull element (14) is designed to transfer a pull force in the working condition, the elongated pull element (14) comprises a bundle of load bearing fibres (41) extending from the first coupler (31) to the second coupler (35), and stiffening means (54, 151, 154) which substantially increase the bending stiffness of the elongated pull element (14) compared to the bending stiffness of the bundle of load bearing fibres (41).

2. Expandable heavy equipment (1) according to clause 1, wherein the stiffening means comprises an exoskeleton (54, 154).
3. Expandable heavy equipment (1) according to clause 2, wherein the exoskeleton (54) comprises one or more rods (53), provided outside of the bundle of load bearing fibres, and extending in a length direction of the elongated pull element, in particular the rods extend from the first coupler (31) to the second coupler (35).
4. Expandable heavy equipment (1) according to clause 3, wherein the rods comprise a plastic, carbon, metal, or glass.
5. Expandable heavy equipment (1) according to clause 3, or 4, wherein a first one of the rods is provided opposite a second one of the rods, with respect to the bundle of load bearing fibres.
6. Expandable heavy equipment (1) according to any one or more of the preceding clauses, wherein the elongated pull element (114) comprises a sleeve (153), arranged circumferential around the elongated pull element (114).
7. Expandable heavy equipment (1) according to clauses 2 and 6, wherein the exoskeleton (154) comprises the sleeve (153), in particular the sleeve (153) comprises a fibre-reinforced plastic, more in particular a fibre-reinforced epoxy.
8. Expandable heavy equipment (1) according to any one or more of the preceding clauses, wherein the stiffening means comprises compression means (151), and the compression means (151) are arranged to compress the load bearing fibres (141).
9. Expandable heavy equipment (1) according to any one or more of the preceding clauses, wherein the elongated pull element (114) comprises tape (149), provided helical around the load bearing fibres (141).
10. Expandable heavy equipment (1) according to clause 8 and 9, wherein the tape (149) functions as compression means (151).
11. Expandable heavy equipment (1) according to any one or more of the preceding clauses, wherein the expandable heavy equipment (1) is a crane, in particular a crawler crane (2), wherein the first frame element is part of a boom.
12. Expandable heavy equipment (1) according to any one or more of the preceding clauses, wherein the load bearing fibres (41) of the elongated pull element (14) extend from the first coupler (31) to the second coupler (35), turn around the second coupler (35), extend from the second coupler (35) to the first coupler (31), and turn around the first coupler (31), such as to form a semi-continuous loop.
13. Expandable heavy equipment (1) according to any one or more of the preceding clauses, wherein at least one of the first (31) and second coupler (35) comprises a thimble (32, 36), and in particular further comprises a matching pin (38).
14. Expandable heavy equipment (1) according to any one or more of the preceding clauses, wherein the first coupler (31) of the elongated pull element (14) matches a coupler (35) of an adjacent further elongated pull element or frame element, in particular the first coupler (31) and the coupler (35) of the adjacent element are connectable in a male-female manner.
15. Expandable heavy equipment (1) according to any one or more of the preceding clauses, wherein the load bearing fibres (41) comprise synthetic fibres, in particular the synthetic fibres are Ultra High Molecular Weight Polyethylene fibres, or aramid fibres, more in particular aramid fibres coated with a wax.
16. Elongated pull element (14), in particular for an expandable heavy equipment (1) according to any one or more of the preceding clauses, wherein the elongated pull element (14) comprises a bundle of load bearing fibres (41) extending along the length of the elongated pull element (14), and stiffening means (54, 151, 154) which increase the bending stiffness of the elongated pull element (14) at least 20 times, preferably at least 40 times, more preferably at least 60 times, compared to the bending stiffness of the load bearing fibres (41).
17. Frame element, in particular designed to form a boom (4), provided with an elongated pull element (14) according to clause 16, wherein the elongated pull element extends in a length direction of the frame element, in particular the elongated pull element is provided outside of an outside the frame element, more in particular the first frame element is provided with at least one support (40), and the elongated pull element is supported by the at least one support.

The invention claimed is:

1. Expandable heavy equipment, comprising:

a frame with a first frame element, a connector, at least one elongated pull element, and further frame elements, the further frame elements comprising at least a second frame element, wherein the at least one elongated pull element comprises a first coupler at a first end and a second coupler at a second end opposite of the first end, and is connected at the first end to the second frame element or to a second elongated pull element with the first coupler and at the second end to one of the further frame elements or to the second elongated pull element or a third elongated pull element with the second coupler, and the at least one elongated pull element comprises a bundle of load bearing fibers extending from the first coupler to the second coupler, and stiffening means for increasing the bending stiffness of the at least one elongated pull element compared to the bending stiffness of the bundle of load bearing fibers, and the stiffening means comprises an exoskeleton, which exoskeleton comprises one or more rods, provided outside of the bundle of load bearing fibers, and extending in a length direction of the at least one elongated pull element, wherein when the expandable heavy equipment is in a transport condition, the first frame element and the second frame element are arrangeable compact together, and when the expandable heavy equipment is in a working condition, the first frame element and the second frame element occupy more space in at least one direction than in the transport condition, the connector is configured to allow a movement of the first frame element and the second frame element with respect to each other from the transport condition to the working condition, and wherein the connector is arranged for connecting the first frame element and the second frame element in the working condition, and wherein the at least one elongated pull element is configured to transfer a pull force in the working condition.

2. The expandable heavy equipment according to claim 1, wherein the rods extend from the first coupler to the second coupler.

3. The expandable heavy equipment according to claim 1, wherein the rods comprise a material selected from the group consisting of: plastic, carbon, metal, and glass.

4. The expandable heavy equipment according to claim 1, wherein a first one of the rods is provided opposite a second one of the rods, with respect to the bundle of load bearing fibers.

5. The expandable heavy equipment according to claim 1, wherein the elongated pull element comprises a sleeve that is arranged circumferential around the elongated pull element.

6. The expandable heavy equipment according to claim 5, wherein the exoskeleton comprises the sleeve, which sleeve is formed of a fiber-reinforced plastic or a fiber-reinforced epoxy.

7. The expandable heavy equipment according to claim 1, wherein the exoskeleton comprises a compression layer for fixating the rods.

8. The expandable heavy equipment according to claim 1, wherein the stiffening means comprises compression means that are configured to compress the load bearing fibers.

9. The expandable heavy equipment according to claim 1, wherein the elongated pull element comprises tape helically wound around the load bearing fibers.

10. The expandable heavy equipment (1) according to claim 9, wherein the stiffening means comprises compression means that are configured to compress the load bearing fibers, and wherein the tape functions as the compression means.

11. The expandable heavy equipment according to claim 1, wherein the expandable heavy equipment is a crane, and wherein the first frame element is part of a boom.

12. The expandable heavy equipment according to claim 1, wherein the load bearing fibers of the elongated pull element extend from the first coupler to the second coupler, turn around the second coupler, extend from the second coupler to the first coupler, and turn around the first coupler, such as to form a semi-continuous loop.

13. The expandable heavy equipment according to claim 1, wherein at least one of the first and second coupler comprises a thimble, and further comprises a matching pin.

14. The expandable heavy equipment according to claim 1, wherein the load bearing fibers comprise a material selected from the group consisting of:

synthetic fibers, Ultra High Molecular Weight Polyethylene fibers, aramid fibers, and aramid fibers coated with a wax.

15. An elongated pull element for an expandable heavy equipment, comprising:

a first coupler at a first end and a second coupler at a second end opposite of the first end, a bundle of load bearing fibers extending along the length of the elongated pull element, and stiffening means for increasing bending stiffness of the elongated pull element compared to bending stiffness of the bundle of load bearing fibers, wherein the stiffening means comprises an exoskeleton, which exoskeleton comprises one or more rods, provided outside of the bundle of load bearing fibers, and extending in a length direction of the elongated pull element, and wherein the elongated pull element is configured to transfer a pull force.

* * * * *